United States Patent [19]

Baum

[11] Patent Number: 4,800,600

[45] Date of Patent: Jan. 31, 1989

[54] DECORATIVE CRIB BUMPER

[76] Inventor: Marilyn J. Baum, 15822 Castlewoods Dr., Sherman Oaks, Calif. 91403

[21] Appl. No.: 898,439

[22] Filed: Aug. 20, 1986

[51] Int. Cl.[4] ..... A47D 9/00

[52] U.S. Cl. ..... 5/93 R; 5/424

[58] Field of Search ..... 5/424, 425, 427, 100, 5/93 R, 431, 434, 436, 193, 280, 448, 465, 508, 512, 513; D6/598, 599, 606; 446/72, 227, 369

[56] References Cited

U.S. PATENT DOCUMENTS

| | | | |
|---|---|---|---|
| D. 86,345 | 3/1932 | Arnold | D6/599 |
| D. 258,406 | 3/1981 | Elbaum et al. | D6/599 |
| D. 279,727 | 7/1985 | Mitchell | D6/599 X |
| 1,435,267 | 11/1922 | Vathe | 446/369 |
| 2,961,668 | 11/1980 | Hayes | D6/599 X |
| 3,018,492 | 1/1962 | Rosen | 5/100 X |
| 3,736,603 | 6/1973 | Rothman | 5/280 X |
| 3,877,090 | 4/1975 | Schutz | 5/93 R |
| 4,186,457 | 2/1983 | Amelung | 5/427 X |
| 4,197,604 | 4/1980 | Nakamura | D6/599 X |
| 4,280,292 | 7/1981 | Hills | D21/156 X |
| 4,525,883 | 7/1985 | Necowitz | 5/100 X |
| 4,670,923 | 6/1987 | Gabriel et al. | 5/424 |

FOREIGN PATENT DOCUMENTS

| | | | |
|---|---|---|---|
| 795742 | 5/1958 | United Kingdom | 5/427 |
| 868320 | 5/1961 | United Kingdom | 5/427 |
| 2030448 | 4/1980 | United Kingdom | 5/436 |

*Primary Examiner*—Michael F. Trettel

*Attorney, Agent, or Firm*—Spensley Horn Jubas & Lubitz

[57] ABSTRACT

A fancifully-shaped crib bumper having stuffed legs serving in the traditional role of a crib bumper, as well as stuffed arms that provide added protection higher up on the side of a crib. The tubular arms and legs of the novel crib bumper are stuffed by using rolled fiberfill batting, which is placed in an insertion device that may be either preformed in a tubular shape or may comprise a flexible sheet material that is rolled around the rolled fiberfill batting. The use of the insertion device permits the rolled fiberfill batting to be inserted into a crib bumper leg or arm in a simple, easy manner, and is then removed, leaving the fiberfill batting in place. The fiberfill batting is then securely attached to the outer casing of the crib bumper by stitching.

10 Claims, 2 Drawing Sheets

DECORATIVE CRIB BUMPER

BACKGROUND OF THE INVENTION

1. Field of the Invention

This invention relates to bedding items, and more particularly to a stuffed crib bumper and an improved method for making same.

2. Related Art

Stuffed "crib bumpers" (although they may be used with a child's bed in addition to use with a crib) for baby cribs and children's beds has become increasingly popular, both as decorative items and a safety device to prevent a baby from hitting the sides of a crib, or to prevent a toddler from rolling off of a bed. Such items have in the past primarily consisted of stuffed cylinders of cloth attached by ties to the perimeter of a crib. Although often made of colorful materials, such prior art crib bumpers typically have exhibited no added functionality such as comprising a toy for a child or a headboard for a bed.

Another problem with prior art bumper cribs is that they tend to be loosely stuffed with filler material. This tends to result in the filler material being redistributed as the crib bumper is handled, and particularly when it is washed, such that the crib bumper tends to lose its shape.

The present invention improves upon prior crib bumpers by being configured in a clown shape, animal shape (such as bear or lion), or other eye catching shape such that a tot sees the crib bumper as a toy and not just as a protective barrier. In addition, an improved method of stuffing the innovative crib bumper with fiberfill batting material and attaching the batting so that the crib bumper retains it shape, even after washing, is disclosed.

SUMMARY OF THE INVENTION

One embodiment of the present invention is a clown-shaped crib bumper having stuffed legs serving in the traditional role of a crib bumper, as well as stuffed arms that provide added protection higher up on the side of a crib. Hook-and-loop attachment ties are used to securely affix the novel crib bumper to a crib or to the mattress of a standard bed. When used with a bed, the body of the crib bumper may be attached to a wall to serve as a padded headboard.

The tubular arms and legs of the novel crib bumper are stuffed by using rolled fiberfill batting, which is placed in a insertion device that may be either preformed in a tubular shape or may comprise a flexible sheet material that is rolled around the rolled fiberfill batting. The use of the insertion device permits the rolled fiberfill batting to be inserted into a crib bumper leg or arm in a simple, easy manner, and is then removed, leaving the fiberfill batting in place. The fiberfill batting is then securely attached to the outer casing of the crib bumper by stitching.

DESCRIPTION OF THE DRAWINGS

Like figures in the various drawings refer to like elements.

DETAILED DESCRIPTION

Figure 1:
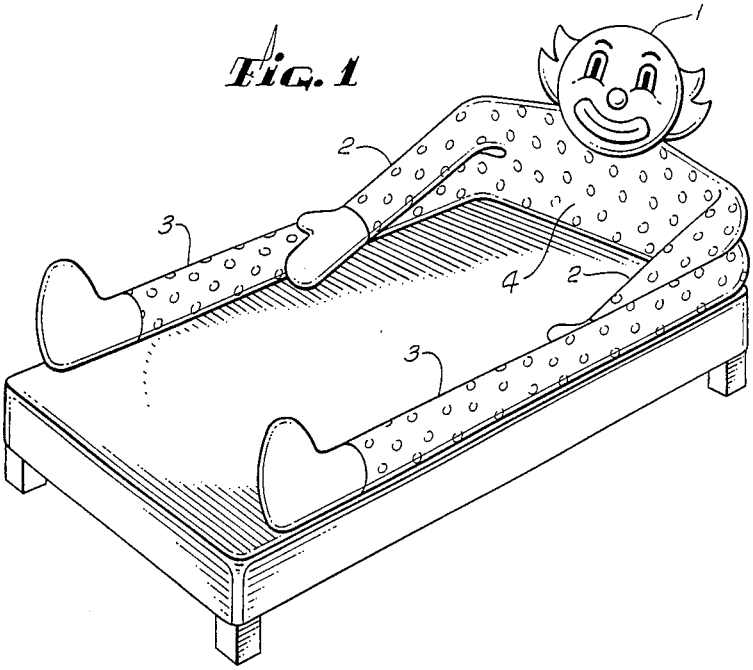
FIG. 1 is a perspective drawing of one embodiment of a crib bumper in accordance with the present invention, situated on a bed.

FIG. 1 shows one embodiment of the invention in the configuration of a clown having a head 1, arms 2, legs 3, and body 4. As shown in FIG. 1, the crib bumper may be attached to a child's bed as well as to a crib. The legs 3 of the crib bumper may be securely fastened to a fitted sheet, for example, by using hook-and-loop fasteners with one portion sewn to the fitted sheet and the other being attached to the crib bumper. In this manner, the legs are securely fastened to the sides of the bed and help prevent a child from rolling off of the bed by serving as a barrier or boundary. When used with a bed, the body of the crib bumper may be attached to a wall (using curtain rods, eye hooks, or similar means) to serve as a padded headboard.

Figure 2:
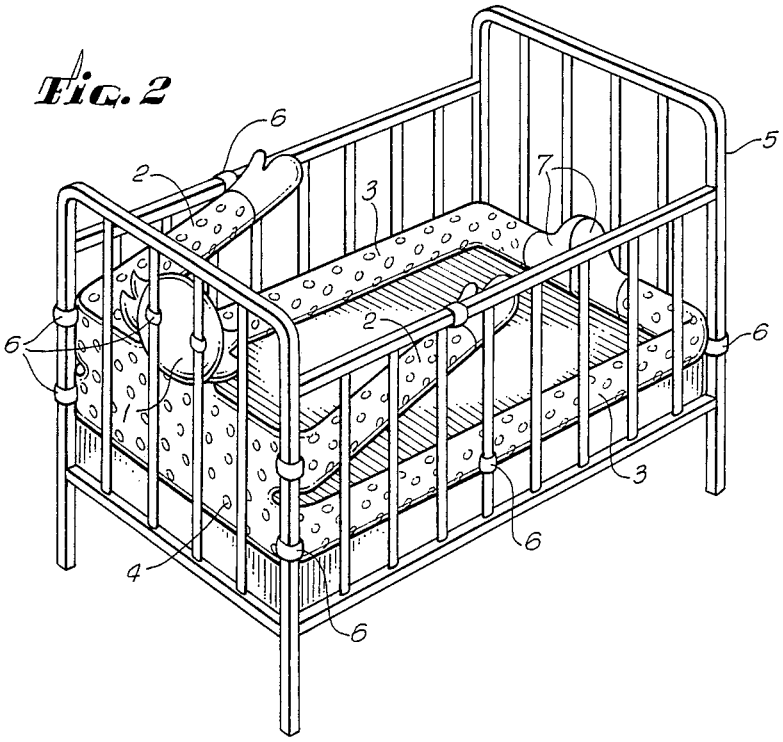
FIG. 2 is a perspective view of one embodiment of the present invention situated in a crib, as seen from a rear corner.

FIG. 2 discloses one embodiment of the present invention situated inside a baby crib 5, and affixed to the sides of the crib by means of ties 6, which may be cloth ties or hook-and-loop fasteners. The arms 2 of the crib bumper are attached to the crib sides at a level that is higher than the legs 3, to provide added protection for a baby's head. The feet 7 of the crib bumper wrap around to form a protective barrier at the foot of the crib, and may be fastened together with means of hook-and-loop fasteners if desired. The head 1 the body 4 of the crib bumper serve to protect a baby's head from making contact with the headboard or bars of the crib.

Figure 4:
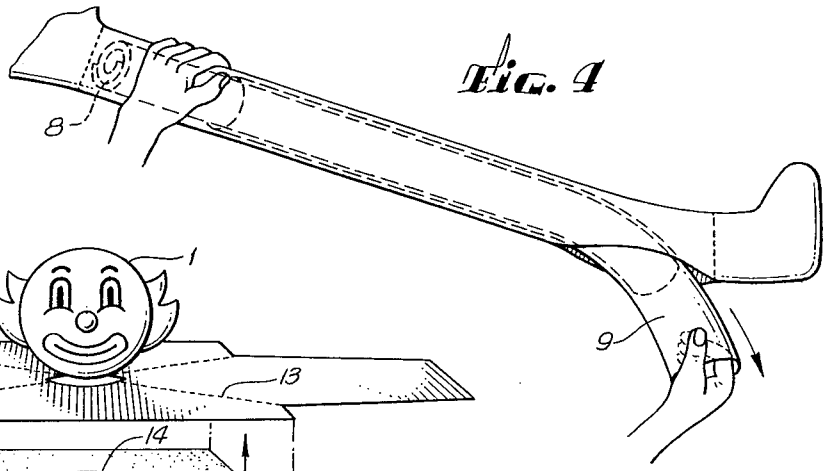
FIG. 4 shows, in a transparent front view, the use of an insertion sheet to stuff one appendage of the novel crib bumper.
Figure 3:
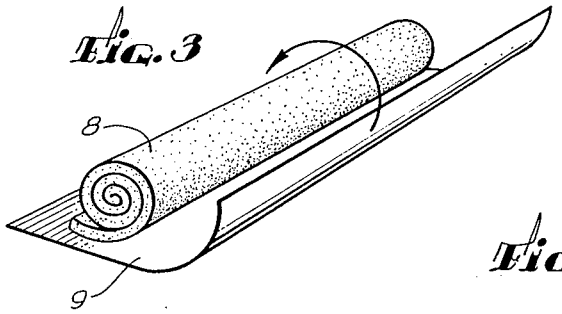
FIG. 3 is a perspective drawing of one method of wrapping fiberfill batting in a flexible insertion sheet.

FIG. 3 shows fiberfill batting 8 rolled into a cylindrical shape. In one embodiment, a flexible plastic sheet 9 is rolled around the batting 8, and acts as an insertion tube. FIG. 4 shows how the insertion tube 9 with enclosed batting 8 is used to insert the batting into a presewn appendage (in this case, a leg) of the crib bumper through an opening in a seam. The insertion tube 9 is then withdrawn as the batting 8 is held in place by hand.

Figure 5:
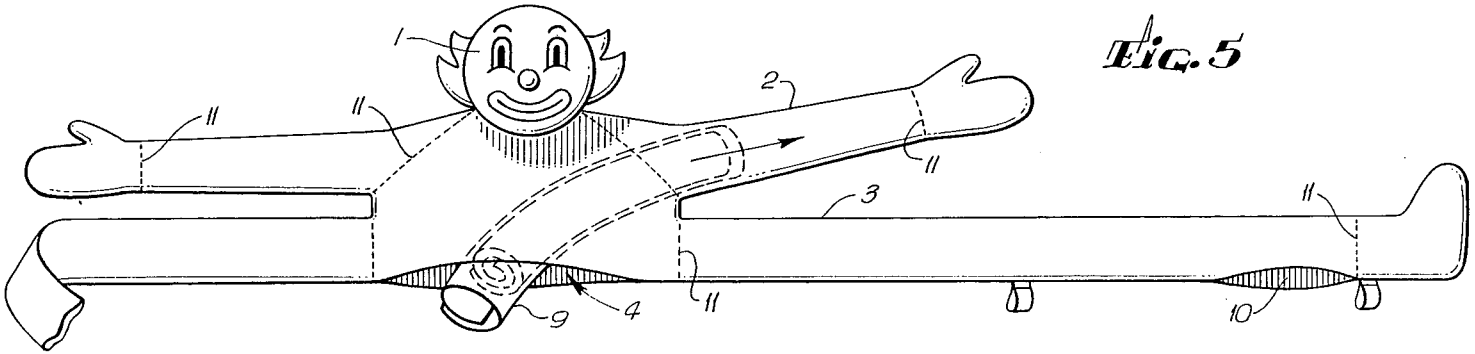
FIG. 5 is a front view of the novel crib bumper, showing the use of the insertion sheet to stuff an arm member of the novel crib bumper.

FIG. 5 shows a similar use of the insertion tube 9 to stuff an arm 2 of the crib bumper. As indicated, the bottom portion of the body 4 has been left open so that the insertion tube 9 has access to the arm 2. FIG. 5 also shows an open seam 10 through which the insertion tube 9 is inserted as in FIG. 4 to stuff the legs of the crib bumper.

FIG. 5 also shows, by dotted lines 11, where seams are sewn in the body and appendages of the crib bumper to help connect the different components of the crib bumper together and prevent the fiberfill batting in the arms and legs from shifting to or fro as the crib bumper is handled or when it is washed. This helps insure that the crib bumper retains its shape, thereby increasing its attractiveness and its effectiveness as a protective bumper.

Figure 6:
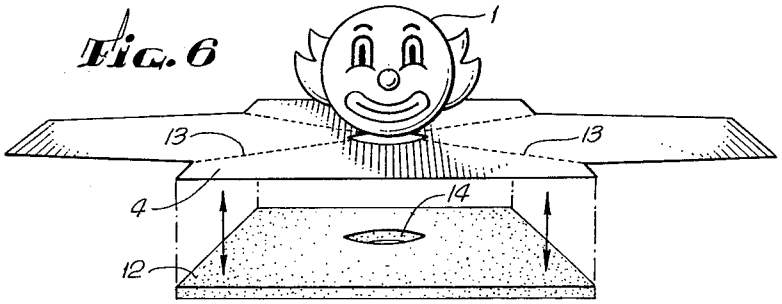
FIG. 6 shows a front exploded view of the manner of attaching fiberfill batting to the body of the crib bumper.

FIG. 6 shows in exploded form how the body 4 and head 1 of the crib bumper are attached to fiberfill batting 12. The fiberfill batting 12 is firmly attached to the body 4 by stitching 13. Such stitching helps insure that the body 4 of the crib bumper retains its shape during use and washing. The head 1 is stitched to the fiberfill batting 11 over an opening 14, so that the head 1 can be stuffed after the head 1 is attached to the fiberfill batting 12. Similarly, the body 4 is stuffed after the arms 2 and legs 3 are attached.

The present invention can be configured to resemble a clown, with appropriate decoration of the body, arms, legs, and head. Further, the present invention can be configured to resemble a fanciful animal, such as a teddy bear, a panda, a lion, and so forth. As another means of stuffing such a crib bumper, a pre-formed stiffened cylinder may be used in place of the sheet-like insertion device describe above, in which rolled fiberfill batting is placed prior to stuffing an appendage of the crib bumper. Other adaptations of the inventive concept would be obvious to one skilled in the art. Thus, the scope of the invention is not limited to the present disclosure, but by the scope of the following claims.

I claim:

1. A crib bumper comprising:

a. a mattress having two opposed ends and two opposed side edges;

b. a body having upper and lower edges and opposite sides and stuffed with a firmly packed resilient material and located at one mattress end;

c. a fanciful head attached to the body;

d. a pair of legs, stuffed with a firmly packed resilient material, said legs attached to the body on the opposite sides thereof and extending along the side edges of said mattress to form a cushioned bumper along the periphery of said mattress; and e. a pair of stuffed arms attached to the body on the opposite sides thereof.

2. The invention of claim 1 wherein the arms include attachment means for attaching the arms to respective sides of a crib.

3. The invention of claim 1 wherein the legs include means for attaching the legs to a crib or mattress.

4. The invention of claim 1 wherein the body, legs, and arms are decorated in the manner of a clown suit, and the head is configured as a clown head.

5. The invention of claim 1 wherein the body, legs, and arms are decorated in the manner of an animal figure, and the head is configured as an animal head.

6. The invention of claim 1 wherein when the crib bumper is used with a bed, the body includes attachment means for attaching the body to a wall to serve as a padded headboard.

7. A crib and crib bumper comprising:

a. a crib having a mattress surrounded by four crib walls;

b. a body having upper and lower edges and opposite sides and stuffed with a firmly packed resilient material, said body being adjacent one of said crib walls;

c. a fanciful head attached to the upper edge of the body;

d. a pair of legs, stuffed with a firmly packed resilient material, said legs attached to the body on the opposite sides thereof and extending from the body in opposite directions along the crib walls to form a cushioned bumper along the periphery of said mattress and including means for attaching the legs to said crib; and e. a pair of stuffed arms attached to the body on the opposite sides thereof, including attachment means for attaching the arms to respective sides of a crib.

8. The invention of claim 7 wherein the body, legs, and arms are decorated in the manner of a clown suit, and the head is configured as a clown head.

9. The invention of claim 7 wherein the body, legs, and arms are decorated in the manner of an animal figure, and the head is configured as an animal head.

10. A crib and crib bumper comprising:

a. a crib having a mattress surrounded by a head wall, a foot wall, and two opposing side walls;

b. a body stuffed with a firmly packed resilient material and supported by said head wall;

c. a fanciful head attached to the body;

d. a pair of legs, stuffed with a firmly packed resilient material, said legs attached to the body on opposite sides thereof, said legs extending along said opposing side walls and meeting at the middle of said foot wall to form a cushioned bumper around the periphery of said mattress, including means for attaching said legs to said crib; and e. a pair of stuffed arms attached to the body on opposite sides thereof, including attachment means for attaching the arms to the respective side walls.

* * * * *